US011189926B2

(12) United States Patent
Hwang

(10) Patent No.: US 11,189,926 B2
(45) Date of Patent: Nov. 30, 2021

(54) MULTILAYER PATCH ANTENNA

(71) Applicant: AMOTECH CO., LTD., Incheon (KR)

(72) Inventor: Chul Hwang, Incheon (KR)

(73) Assignee: AMOTECH CO., LTD., Incheon (KR)

( * ) Notice: Subject to any disclaimer, the term of this patent is extended or adjusted under 35 U.S.C. 154(b) by 55 days.

(21) Appl. No.: 16/494,287

(22) PCT Filed: Mar. 6, 2018

(86) PCT No.: PCT/KR2018/002638
§ 371 (c)(1),
(2) Date: Sep. 14, 2019

(87) PCT Pub. No.: WO2018/169239
PCT Pub. Date: Sep. 20, 2018

(65) Prior Publication Data

US 2020/0136257 A1 Apr. 30, 2020

(30) Foreign Application Priority Data

Mar. 14, 2017 (KR) ..... 10-2017-0031790

(51) Int. Cl.
*H01Q 9/04* (2006.01)
*H01Q 1/32* (2006.01)

(52) U.S. Cl.
CPC ..... *H01Q 9/0414* (2013.01); *H01Q 1/3275* (2013.01); *H01Q 9/045* (2013.01)

(58) Field of Classification Search
CPC ..... H01Q 1/38; H01Q 9/0414
See application file for complete search history.

(56) References Cited

U.S. PATENT DOCUMENTS 5,055,852 A 10/1991 Dusseux et al.
5,121,127 A * 6/1992 Toriyama ..... H01Q 9/0414 343/700 MS (Continued)

FOREIGN PATENT DOCUMENTS

CN 104183919 A 12/2014
JP H03-32202 A 2/1991

(Continued)

OTHER PUBLICATIONS

European Search Report in Application No. 18766648.2 dated Nov. 24, 2020.

(Continued)

*Primary Examiner* — Hasan Islam
(74) *Attorney, Agent, or Firm* — Maschoff Brennan

(57) ABSTRACT

Presented is a multilayer patch antenna which prevents the occurrence of parasitic resonance by having a metal layer formed on the inner wall of a thru-hole, among a plurality of thru-holes formed in a lower patch antenna, penetrated by a power feeding pin of an upper patch antenna. The multilayer patch antenna presented herein comprises: an upper patch antenna having a first thru-hole formed therein; a lower patch antenna having a second thru-hole and a third thru-hole formed therein, away from each other; a first upper power feeding pin protruding under the lower patch antenna by penetrating the first thru-hole and the second thru-hole; a lower power feeding pin protruding under the lower patch antenna by penetrating the third thru-hole; and a metal layer formed inside the second thru-hole.

9 Claims, 9 Drawing Sheets

(56) References Cited

U.S. PATENT DOCUMENTS

| | | | | |
|---|---|---|---|---|
| 5,153,600 | A | 10/1992 | Metzler et al. | |
| 6,639,558 | B2 * | 10/2003 | Kellerman | H01Q 9/0414 343/700 MS |
| 2003/0146872 | A1 | 7/2003 | Kellerman et al. | |
| 2016/0013558 | A1 * | 1/2016 | Hwang | H01Q 9/0457 343/906 |

FOREIGN PATENT DOCUMENTS

| | | | |
|---|---|---|---|
| JP | 1993-211406 | A | 8/1993 |
| JP | 2002-353730 | A | 6/2002 |
| JP | 2005-124056 | A | 12/2005 |
| JP | 2009-077004 | A | 4/2009 |
| JP | 2014-179824 | A | 9/2014 |
| KR | 10-2010-0110052 | A | 10/2010 |
| KR | 10-2011-0066639 | A | 6/2011 |
| KR | 10-2014-0095130 | A | 1/2014 |

OTHER PUBLICATIONS

Japanese Office Action issued in corresponding application No. 2019-549450, dated Apr. 1, 2021.

* cited by examiner

--Prior Art--

MULTILAYER PATCH ANTENNA

TECHNICAL FIELD

The present disclosure relates to a patch antenna used for a shark antenna for a vehicle, and more particularly, a multilayer patch antenna embedded in a shark antenna mounted on a vehicle to receive a plurality of frequency band signals selected from the frequency bands such as GNSS (L1, L2, L5) and SDARS (Sirius, XM).

BACKGROUND ART

A shark antenna for a vehicle is installed to improve the signal reception rate of the electronic devices installed in the vehicle. The shark antenna for the vehicle is installed outside the vehicle. For example, Korean Patent Laid-Open Publication No. 10-2011-0066639 (title: ANTENNA APPARATUS FOR VEHICLE), Korean Patent Laid-Open Publication No. 10-2010-0110052 (title: ANTENNA APPARATUS FOR VEHICLE), etc. disclose various types of the shark antenna for the vehicle structures.

In recent years, as the electronic devices such as navigation, DMB, and audio are installed, a large number of antennas for receiving signals in the frequency bands such as GNSS (e.g., GPS (US), Glonass (Russia)), SDARS (Sirius, XM), Telematics, FM, and T-DMB are also embedded in the shark antenna for the vehicle.

However, there is a problem in that the mounting space is insufficient as the antennas such as GNSS, SDARS, Telematics, FM, and T-DMB are mounted in the limited mounting space of the shark antenna for the vehicle.

Accordingly, research is being conducted on a multilayer patch antenna in which a plurality of patch antennas have been stacked.

For example, referring to FIG. 1, a multilayer patch antenna is composed of an upper patch antenna 10 for receiving a first frequency band signal and a lower patch antenna 20 disposed under the upper patch antenna 10 to receive a second frequency band signal.

The multilayer patch antenna is formed as a structure in which a power feeding pin 30 for feeding the upper patch antenna 10 penetrates the lower patch antenna 20. At this time, in the multilayer patch antenna, parasitic resonance occurs due to the coupling between the power feeding pin 30 that penetrates the lower patch antenna 20 and the lower patch antenna 20. That is, in the multilayer patch antenna, parasitic resonance, in which the second frequency band signal is received together with the first frequency band signal in the upper patch antenna 10, occurs.

In addition, the multilayer patch antenna has a problem in that isolation between the upper patch antenna 10 and the lower patch antenna 20 is reduced as the parasitic resonance occurs. That is, since the first frequency band signal and the second frequency band signal are received by the upper patch antenna 10, the isolation between the upper patch antenna 10 and the lower patch antenna 20 is reduced.

In addition, the multilayer patch antenna has a problem in that the antenna efficiency is reduced as the isolation is reduced.

DISCLOSURE

Technical Problem

The present disclosure is intended to solve the above problems, and an object of the present disclosure is to provide a multilayer patch antenna, which forms a metal layer on the inner wall of a thru-hole through which a power feeding pin of an upper patch antenna among a plurality of thru-holes formed on a lower patch antenna passes, thereby preventing the occurrence of parasitic resonance.

Technical Solution

A multilayer patch antenna according to an embodiment of the present disclosure for achieving the object may include an upper patch antenna having a first thru-hole formed therein, a lower patch antenna having a second thru-hole and a third thru-hole formed to be spaced apart from each other, a first upper power feeding pin protruding under the lower patch antenna by penetrating the first thru-hole and the second thru-hole, a lower power feeding pin protruding under the lower patch antenna by penetrating the third thru-hole, and a metal layer formed inside the second thru-hole.

The upper patch antenna may be further formed with a fourth thru-hole spaced apart from the first thru-hole, the lower patch antenna may be further formed with a fifth thru-hole spaced apart from the second thru-hole and the third thru-hole, and the multilayer patch antenna may further include a second upper power feeding pin penetrating the fourth thru-hole and the fifth thru-hole to be protruded downwards from the lower patch antenna. At this time, a metal layer may be formed on the inner wall surface of the fifth thru-hole.

Advantageous Effects

According to the present disclosure, the multilayer patch antenna may form a metal layer on the inner wall of the thru-hole through which the power feeding pin of the upper patch antenna passes among the plurality of thru-holes formed on the lower patch antenna, thereby preventing the occurrence of parasitic resonance.

In addition, it is possible to form the metal layer on the inner wall of the thru-hole through which the power feeding pin of the upper patch antenna passes among the plurality of thru-holes formed on the lower patch antenna to prevent the occurrence of the parasitic resonance, thereby preventing the isolation between the upper patch antenna and the lower patch antenna from being reduced.

In addition, it is possible to form the metal layer on the inner wall of the thru-hole through which the power feeding pin of the upper patch antenna passes among the plurality of thru-holes formed on the lower patch antenna to prevent the isolation between the patch antennas from being reduced, thereby preventing the antenna efficiency from being reduced.

BEST MODE

Figure 1:
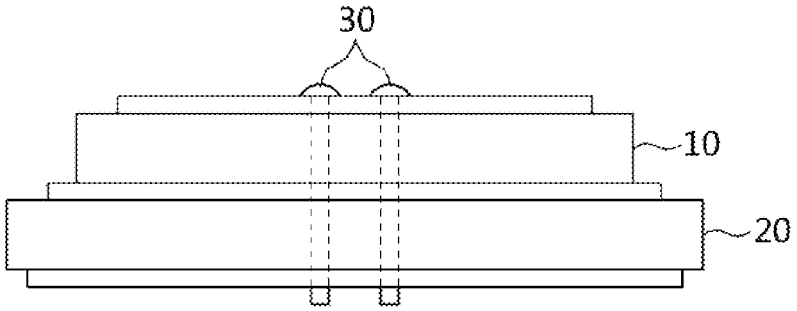
FIG. 1 is a diagram for explaining a conventional multilayer patch antenna.

Hereinafter, the most preferred embodiments of the present disclosure will be described with reference to the accompanying drawings so that those skilled in the art to which the present disclosure pertains may easily carry out the technical spirit of the present disclosure. First, in adding reference numerals to the components of each drawing, it should be noted that the same components have the same reference numerals as much as possible even if they are displayed on different drawings. In addition, in describing the present disclosure, when it is determined that the detailed description of the related well-known configuration or function may obscure the gist of the present disclosure, the detailed description thereof will be omitted.

Figure 2:
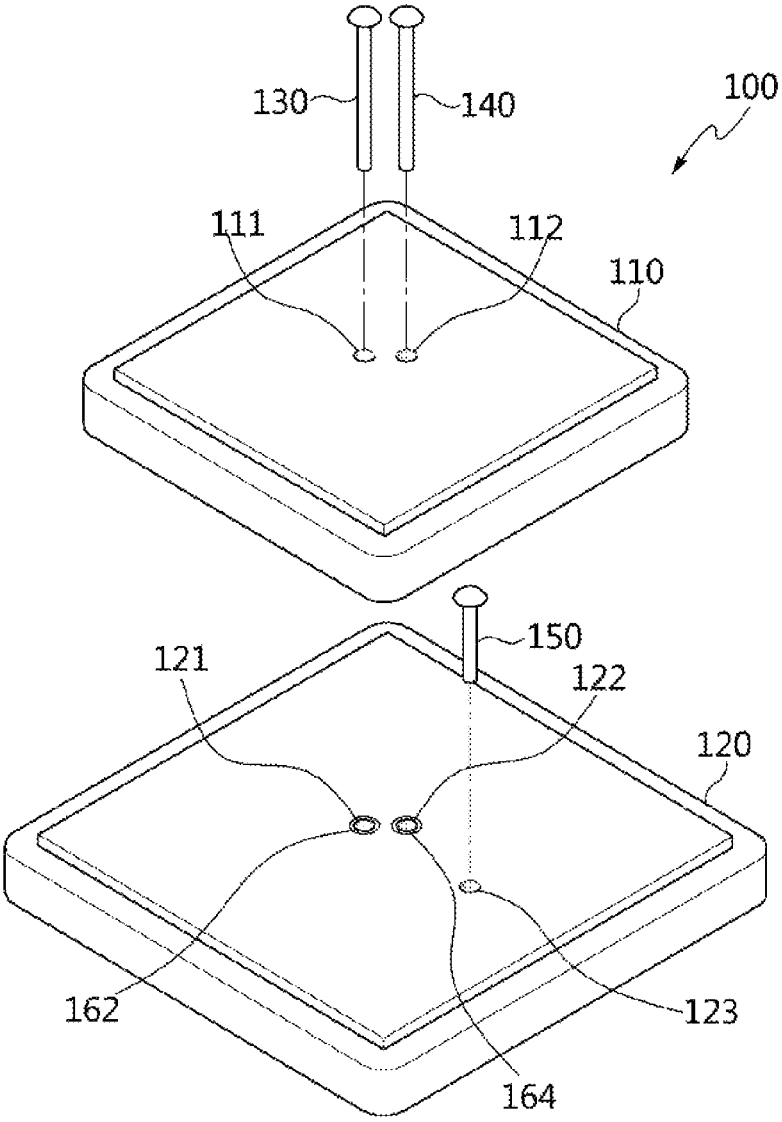
FIGS. 2 and 3 are diagrams for explaining a multiplayer patch antenna according to an embodiment of the present disclosure.
Figure 3:
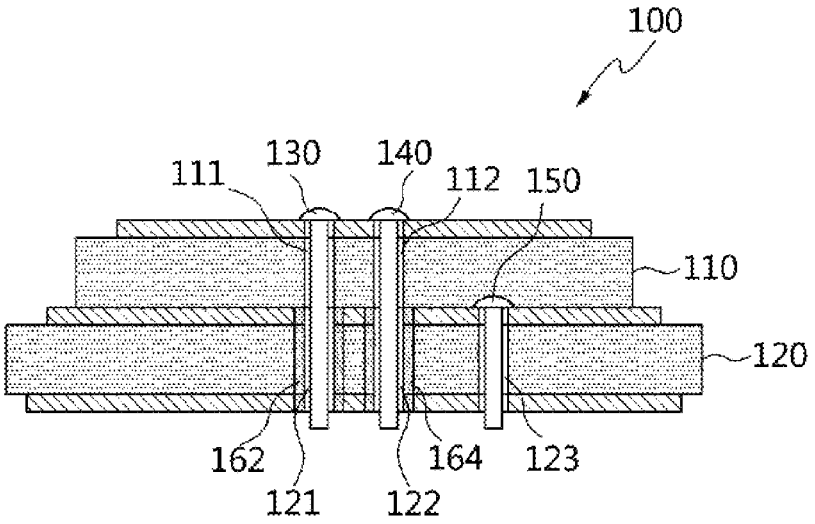

Referring to FIGS. 2 and 3, a multilayer patch antenna 100 is configured to include an upper patch antenna 110, a lower patch antenna 120, a first power feeding pin 130, a second power feeding pin 140, a third power feeding pin 150, and a metal layer 160. Here, the first power feeding pin 130 corresponds to a first upper power feeding pin recited in claims, the second power feeding pin 140 corresponds to a second upper power feeding pin recited in claims, and the third power feeding pin 150 corresponds to a lower power feeding pin recited in claims.

The upper patch antenna 110 receives a signal of a first frequency band. The upper patch antenna 110 is formed with a first thru-hole 111 through which the first power feeding pin 130 penetrates and a fourth thru-hole 112 through which the second power feeding pin 140 penetrates. At this time, the virtual line connecting the first thru-hole 111 with the center point of the upper patch antenna 110 and the virtual line connecting the fourth thru-hole 112 with the center point of the upper patch antenna 110 are formed at a setting angle. Here, the setting angle may be formed in the range of about 70 degrees to 100 degrees.

Figure 4:
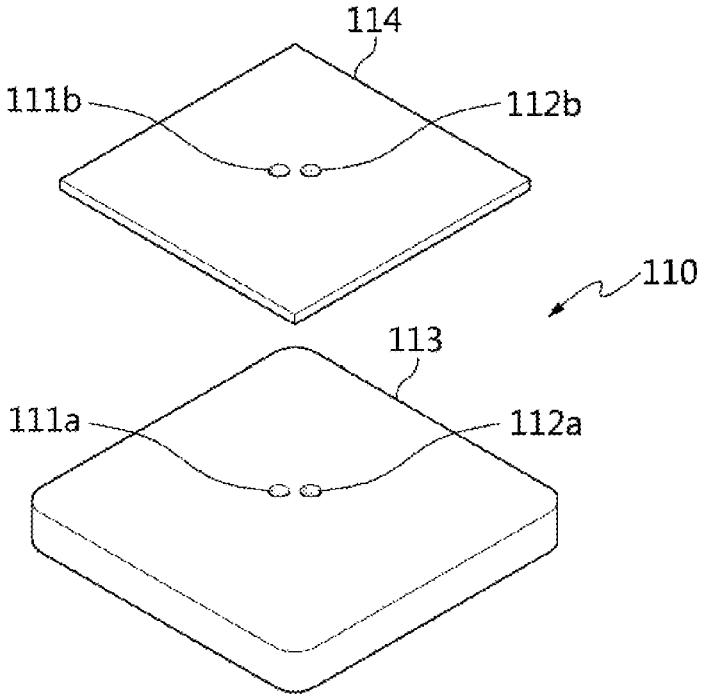
FIG. 4 is a diagram for explaining an upper patch antenna of FIG. 2.

Referring to FIG. 4, the upper patch antenna 110 is configured to include a first base substrate 113 and a first upper radiation patch 114.

The first base substrate 113 is made of a dielectric or magnetic material. The first base substrate 113 may be formed of a dielectric substrate made of a ceramic material having characteristics such as high dielectric constant and low thermal expansion coefficient, or may be a magnetic substrate made of a magnetic material such as ferrite.

The first base substrate 113 is formed with a 1-1$^{th}$ thru-hole 111*a* through which the first power feeding pin 130 penetrates and a 4-1$^{th}$ thru-hole 112*a* through which the second power feeding pin 140 penetrates. At this time, the 1-1$^{th}$ thru-holes 111*a* and the 4-1$^{th}$ thru-hole 112*a* may be formed to have a setting angle, and formed so that the virtual line connecting the 1-1$^{th}$ thru-hole 111*a* with the center point of the first base member 113 and the virtual line connecting the 4-1$^{th}$ thru-hole 112*a* with the center point of the first base member 113 have a setting angle of about 70 degrees to 110 degrees.

The first upper radiation patch 114 is disposed on one surface of the first base substrate 113 with a thin plate of a conductive material having high electrical conductivity, such as copper, aluminum, gold, or silver. The first upper radiation patch 114 may be formed in various shapes such as square, triangle, and octagon.

The first upper radiation patch 114 is formed with a 1-2$^{th}$ thru-hole 111*b* through which the first power feeding pin 130 penetrates and a 4-2$^{th}$ thru-hole 112*b* through which the second power feeding pin 140 penetrates. At this time, the 1-2$^{th}$ thru-hole 111*b* and the 4-2$^{th}$ thru-hole 112*b* may be formed to have a setting angle, and formed so that the virtual line connecting the 1-2$^{th}$ thru-hole 111*b* with the center point of the first upper radiation patch 114 and the virtual line connecting the 4-2$^{th}$ thru-hole 112*b* with the center point of the first upper radiation patch 114 have a setting angle of about 70 degrees to 110 degrees. Here, the 1-2$^{th}$ thru-hole 111*b* and the 4-2$^{th}$ thru-hole 112*b* are disposed above the 1-1$^{th}$ thru-hole 111*a* and the 4-1$^{th}$ thru-hole 112*a* when the first upper radiation patch 114 is disposed on the first base substrate 113.

The lower patch antenna 120 receives a signal of a second frequency band. The lower patch antenna 120 is formed with a second thru-hole 121 through which the first power feeding pin 130 having penetrated the first thru-hole 111 penetrates, and a fifth thru-hole 122 through which the second power feeding pin 140 having penetrated the fourth thru-hole 112 penetrates. At this time, the virtual line connecting the second thru-hole 121 with the center point of the lower patch antenna 120 and the virtual line connecting the fifth thru-hole 122 with the center point of the lower patch antenna 120 are formed at a setting angle. Here, the setting angle may be formed in the range of about 70 degrees to 100 degrees.

The lower patch antenna 120 is formed with a third thru-hole 123 through which a third power feeding pin 150 penetrates. At this time, the third thru-hole 123 is disposed to be spaced apart from the second thru-hole 121 and the fifth thru-hole 122. Here, for convenience of description, although it has been illustrated in FIGS. 2 and 3 that the present disclosure includes the first power feeding pin 130 and the second power feeding pin 140 for feeding the upper patch antenna 110 and the third power feeding pin 150 for feeding the lower patch antenna 120, the present disclosure is not limited thereto and may further include another power feeding pin (not illustrated) for feeding the lower patch antenna 120. At this time, the lower patch antenna 120 may further formed with another thru-hole (not illustrated).

Figure 5:
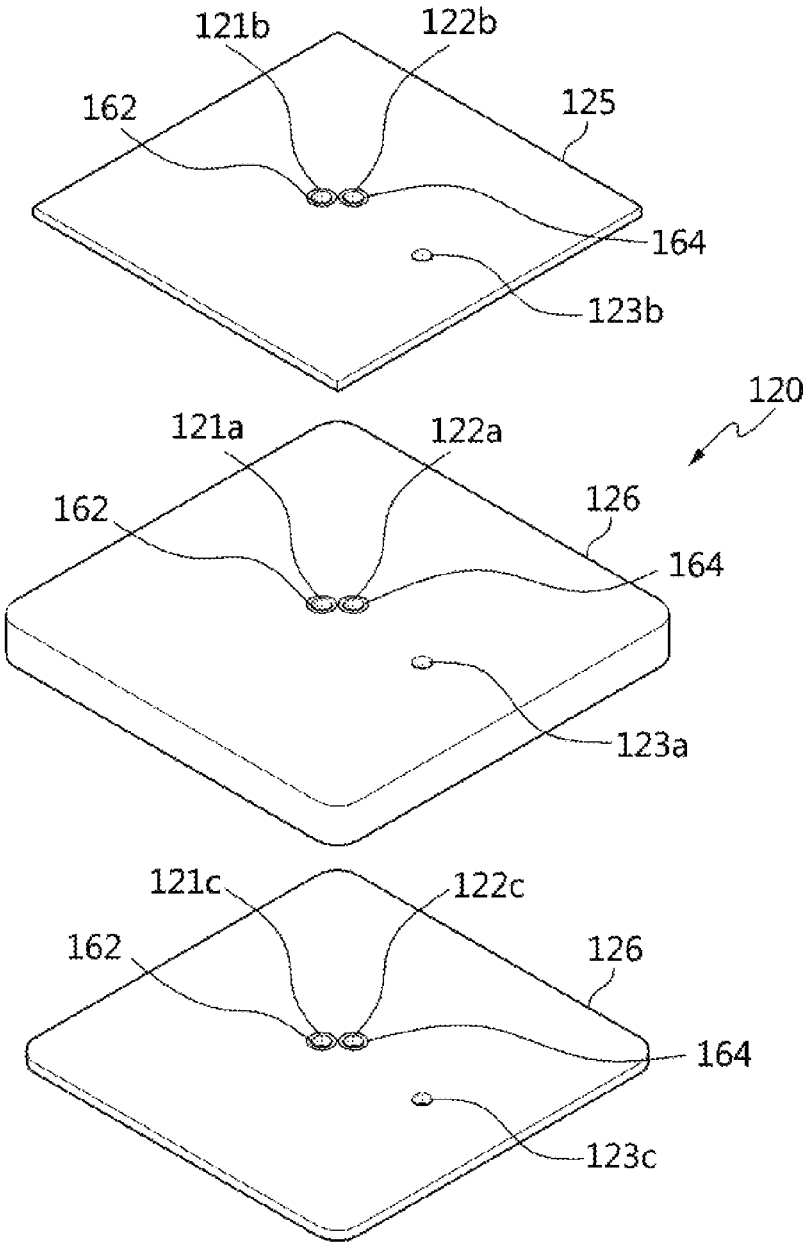
FIG. 5 is a diagram for explaining a lower patch antenna of FIG. 2.

Referring to FIG. 5, the lower patch antenna 120 is configured to include a second base substrate 124, a second upper radiation patch 125, and a lower patch 126.

The second base substrate 124 is made of a dielectric or magnetic material. The second base substrate 124 may be formed of a dielectric substrate of a ceramic material having characteristics such as high dielectric constant and low thermal expansion coefficient, or may be a magnetic substrate made of a magnetic material such as ferrite.

The second base substrate 124 is formed with a 2-1$^{th}$ thru-hole 121*a* through which the first power feeding pin 130 penetrates and a 5-1$^{th}$ thru-hole 122*a* through which the second power feeding pin 140 penetrates. At this time, the 2-1$^{th}$ thru-hole 121*a* and the 5-1$^{th}$ thru-hole 122*a* may be formed to have a setting angle, and formed so that the virtual line connecting the 2-1$^{th}$ thru-hole 121*a* with the center point of the second base substrate 124 and the virtual line connecting the 5-1$^{th}$ thru-hole 122*a* with the center point of the second base substrate 124 have a setting angle of about 70 degrees to 110 degrees.

The second base substrate 124 is formed with a 3-1$^{th}$ thru-hole 123*a* through which the third power feeding pin 150 penetrates. At this time, the 3-1$^{th}$ thru-hole 123*a* is formed to be spaced apart from the 2-1$^{th}$ thru-hole 121*a* and the 5-1$^{th}$ thru-hole 122*a*.

The second upper radiation patch 125 is a thin plate of a conductive material having high electrical conductivity such as copper, aluminum, gold, or silver, and is disposed on one surface of the second base substrate 124. The second upper radiation patch 125 may be formed in various shapes such as square, triangle, and octagon.

The second upper radiation patch 125 is formed with a 2-2$^{th}$ thru-hole 121*b* through which the first power feeding pin 130 penetrates and a 5-2$^{th}$ thru-hole 122*b* through which the second power feeding pin 140 penetrates. At this time, the 2-2$^{th}$ thru-hole 121*b* and the 5-2$^{th}$ thru-hole 122*b* may be formed to have a setting angle, and formed so that the virtual line connecting the 2-2$^{th}$ thru-hole 121*b* with the center point of the second upper radiation patch 125 and the virtual line connecting the 5-2$^{th}$ thru-hole 122*b* with the center point of the second upper radiation patch 125 have a setting angle of about 70 degrees to 110 degrees. Here, the 2-2$^{th}$ thru-hole 121*b* and the 5-2$^{th}$ thru-hole 122*b* are formed above the 2-1$^{th}$ thru-holes 121*a* and the 5-1$^{th}$ thru-hole 122*a* when the second upper radiation patch 125 is disposed on the second base substrate 124.

The second upper radiation patch 125 is formed with a 3-2$^{th}$ thru-hole 123*b* through which the third power feeding pin 150 penetrates. At this time, the 3-2$^{th}$ thru-hole 123*b* is formed to be spaced apart from the 2-2$^{th}$ thru-hole 121*b* and the 5-2$^{th}$ thru-hole 122*b*. The 3-2$^{th}$ thru-hole 123*b* is disposed above the 3-1$^{th}$ thru-hole 123*a* when the second upper radiation patch 125 is disposed on the second base substrate 124.

The lower patch 126 is a thin plate of a conductive material having high electrical conductivity such as copper, aluminum, gold, or silver, and is disposed on the other surface of the second base substrate 124. At this time, the lower patch 126 is a patch for a ground (GND), for example.

The lower patch 126 is formed with a 2-3$^{th}$ thru-hole 121*c* and a 5-3$^{th}$ thru-hole 122*c*. That is, the lower patch 126 is formed with the 2-3$^{th}$ thru-hole 121*c* through which the first power feeding pin 130 penetrates and the 5-3$^{th}$ thru-hole 122*c* through which the second power feeding pin 140 penetrates. At this time, the 2-3$^{th}$ thru-hole 121*c* and the 5-3$^{th}$ thru-hole 122*c* may be formed to have a setting angle, and formed so that the virtual line connecting the 2-3$^{th}$ thru-hole 121*c* with the center point of the lower patch 126 and the virtual line connecting the 5-3$^{th}$ thru-hole 122*c* with the center point of the lower patch 126 have a setting angle of about 70 degrees to 110 degrees. Here, the 2-3$^{th}$ thru-holes 121*c* and the 5-3$^{th}$ thru-holes 122*c* are disposed below the 2-1$^{th}$ thru-hole 121*a* and the 5-1$^{th}$ thru-hole 122*a* when the lower patch 126 is disposed on the second base substrate 124.

The lower patch 126 is formed with a 3-3$^{th}$ thru-hole 123*c* through which the third power feeding pin 150 penetrates. At this time, the 3-3$^{th}$ thru-hole 123*c* is formed to be spaced apart from the 2-3$^{th}$ thru-hole 121*c* and the 5-3$^{th}$ thru-hole 122*c*. The 3-3$^{th}$ thru-hole 123*c* is disposed below the 3-1$^{th}$ thru-hole 123*a* when the lower patch 126 is disposed on the second base substrate 124.

The metal layer 160 is formed in the second thru-hole 121 and the fifth thru-hole 122 of the lower patch antenna 120. That is, the metal layer 160 is formed on the inner wall surfaces of the second thru-hole 121 and the fifth thru-hole 122.

The metal layer 160 is made of one material selected from copper, aluminum, gold, and silver. Of course, the metal layer 160 may also be made of an alloy containing one material selected from copper, aluminum, gold, and silver.

The metal layer 160 constitutes a coaxial cable with the first power feeding pin 130 and the second power feeding pin 140. Accordingly, the metal layer 160 removes parasitic resonance occurred by the coupling between the first power feeding pin 130 and the second power feeding pin 140 and the lower patch antenna 120. As a result, the multilayer patch antenna 100 may prevent isolation from being reduced by the parasitic resonance.

For this purpose, the metal layer 160 may include a first metal layer 162 formed on the inner wall surface of the second thru-hole 121 of the lower patch antenna 120 and a second metal layer 164 formed on the inner wall surface of the fifth thru-hole 122.

The first metal layer 162 is formed on the inner wall surface of the 2-1$^{th}$ thru-hole 121*a*. At this time, the first metal layer 162 is spaced at a predetermined interval apart from the outer circumference of the first power feeding pin 130 penetrating the second thru-hole 121.

The second metal layer 164 is formed on the inner wall surface of the 5-1$^{th}$ thru-hole 122*a*. At this time, the second metal layer 164 is spaced at a predetermined interval apart from the outer circumference of the second power feeding pin 140 penetrating the fifth thru-hole 122.

Meanwhile, the metal layer 160 may be connected to the second upper radiation patch 125 and the lower patch 126. That is, when the metal layer 160 is formed to be spaced apart from the second upper radiation patch 125 and the lower patch 126, the parasitic resonance due to the coupling between the first and second power feeding pins 130, 140 and the lower patch antenna 120 in a spacing space may occur.

The first metal layer 162 is formed on the inner wall surface of the second thru-hole 121. That is, the first metal layer 162 is formed to have a predetermined thickness along the inner wall surfaces of the 2-1$^{th}$ thru-hole 121*a* to the 2-3$^{th}$ thru-hole 121*c* of the lower patch antenna 120. The first metal layer 162 is formed in a cylindrical shape having a hole, through which the first power feeding pin penetrates, formed therein. At this time, the first metal layer 162 is disposed to be spaced at a predetermined interval apart from the outer circumference of the first power feeding pin 130 penetrating the second thru-hole 121. Accordingly, the thickness of the first metal layer 162 may be formed variously according to the cross-sectional diameter of the second thru-hole 121 and the cross-sectional diameter of the first power feeding pin 130.

The first metal layer 162 may also be formed on the inner circumferential surface of the 2-1$^{th}$ thru-hole 121*a* so that both ends thereof may be connected to the 2-2$^{th}$ thru-hole 121*b* and the 2-3$^{th}$ thru-hole 121*c*, respectively.

The second metal layer 164 is formed on the inner wall surface of the fifth thru-hole 122. That is, the second metal layer 164 is formed to have a predetermined thickness along the inner wall surfaces of the 5-1$^{th}$ thru-hole 122*a* to the 5-3$^{th}$ thru-hole 122*c* of the lower patch antenna 120. The second metal layer 164 is formed in a cylindrical shape having a hole, through which the second power feeding pin penetrates, formed therein. At this time, the second metal layer 164 is disposed to be spaced at a predetermined interval apart from the outer circumference of the second power feeding pin 140 penetrating the fifth thru-hole 122. Accordingly, the thickness of the second metal layer 164 may be formed variously according to the cross-sectional diameter of the fifth thru-hole 122 and the cross-sectional diameter of the second power feeding pin 140.

The second metal layer 164 may also be formed on the inner circumferential surface of the 5-1$^{th}$ thru-hole 122*a* so that both ends thereof are connected to the 5-2$^{th}$ thru-hole 122*b* and the 5-3$^{th}$ thru-hole 122*c*, respectively.

Accordingly, the first metal layer 162 is formed on the inner wall surface of the second thru-hole 121, has one end connected with the second upper radiation patch 125, and has the other end connected with the lower patch 126. The second metal layer 164 is formed on the inner wall surface of the fifth thru-hole 122, has one end connected with the second upper radiation patch 125, and has the other end connected with the lower patch 126. At this time, the metal layer 160 may be formed on the inner wall surfaces of the second thru-hole 121 and the fifth thru-hole 122 with a metal material by using one process selected from an electroless plating process, an electrolytic plating process, and a copper foil bonding process.

As a result, the multilayer patch antenna 100 may prevent the parasitic resonance from occurring, thereby preventing isolation and antenna efficiency from being reduced.

Figure 6:
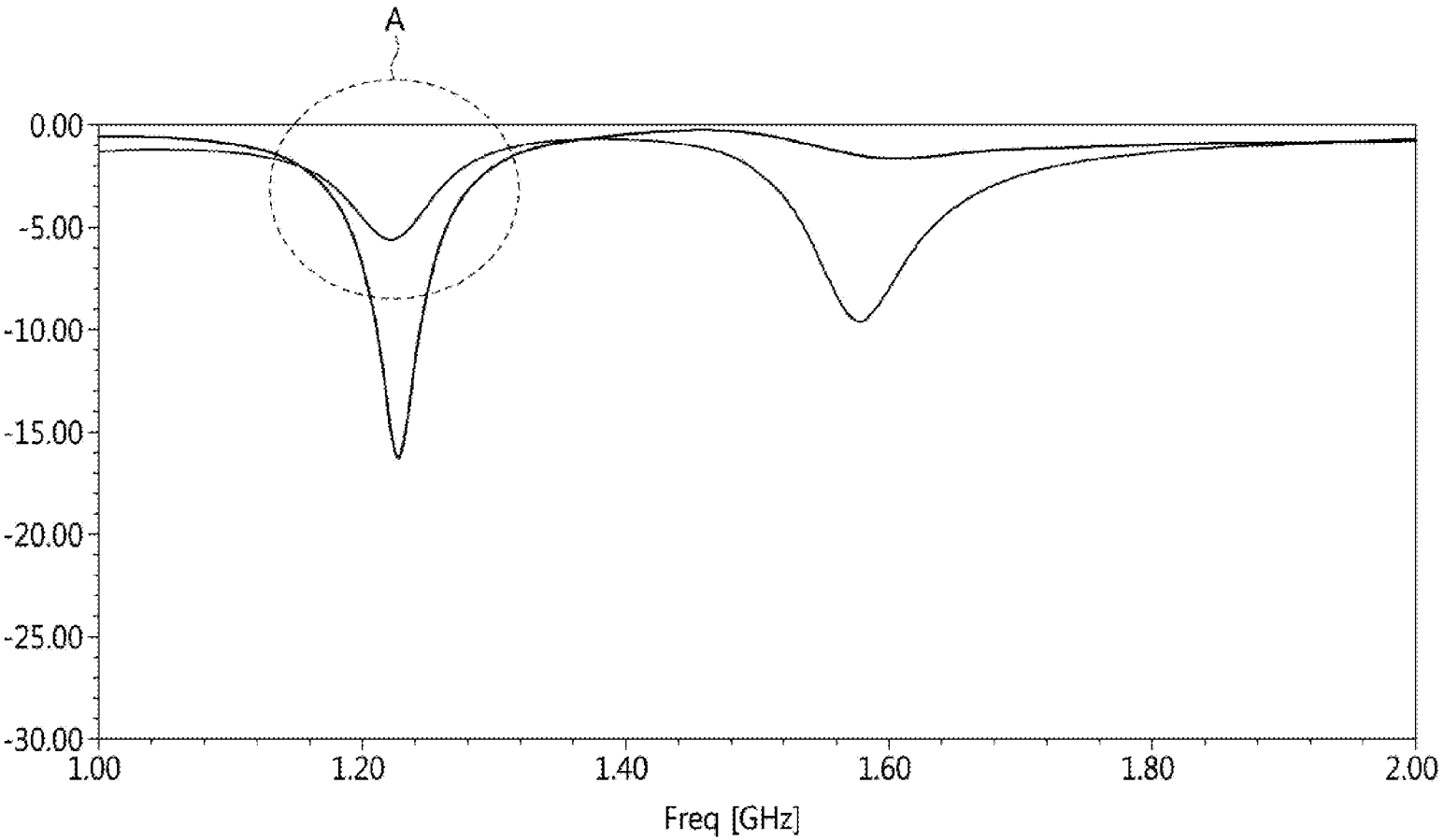
FIGS. 6 to 9 are diagrams for explaining the multilayer patch antenna according to an embodiment of the present disclosure and the conventional multilayer patch antenna.
Figure 7:
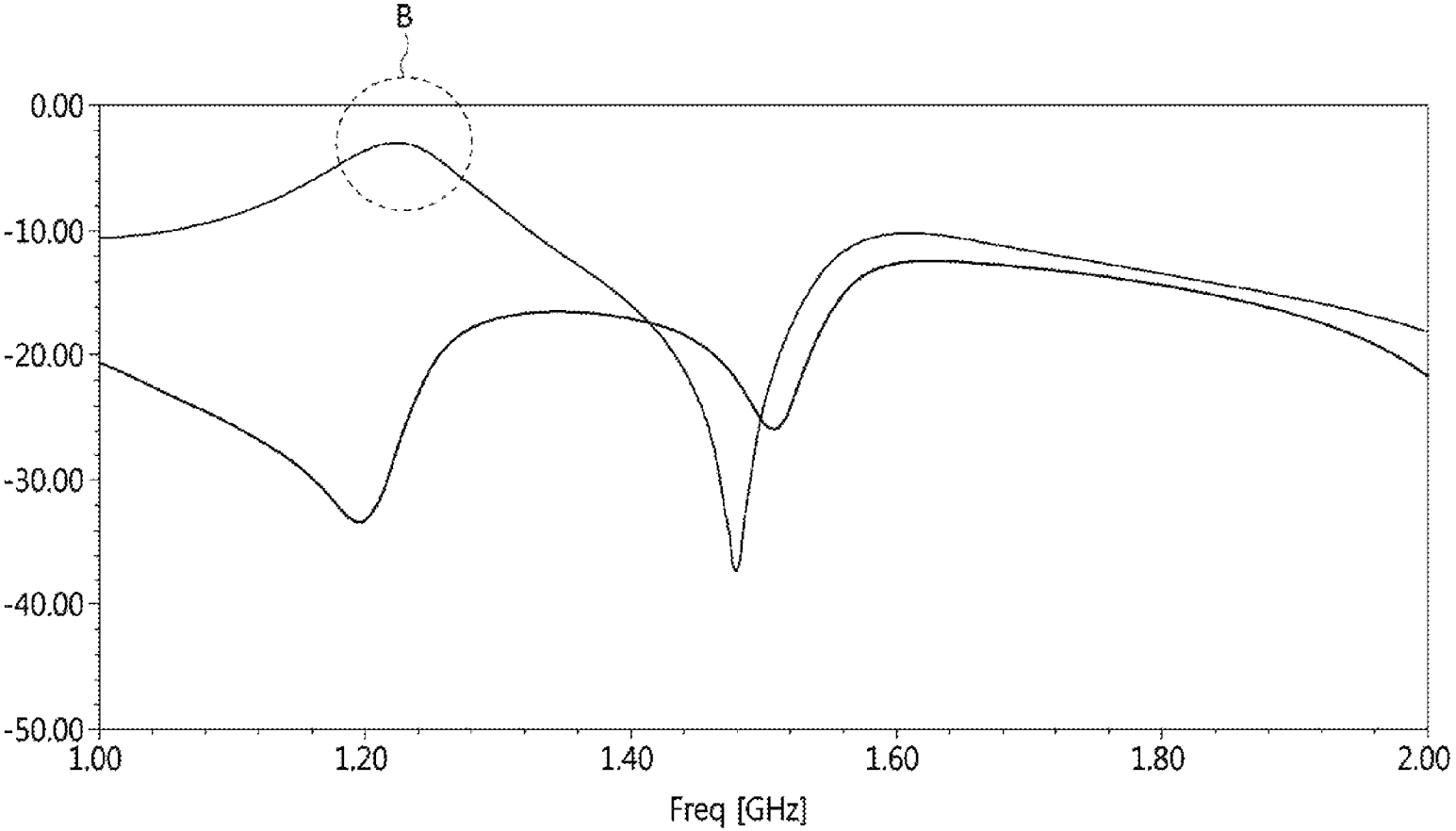

That is, referring to FIGS. 6 and 7, the conventional multilayer patch antenna causes parasitic resonance (A) that resonates in a first frequency band and a second frequency band in the upper patch antenna 10 by coupling between the lower patch antenna 20 and the power feeding pin 30.

Accordingly, the conventional multilayer patch antenna forms the isolation of about 3.04 dB @ 1225 MHz (Peak) (B) because the second frequency band signal together with the first frequency band signal is received from the upper patch antenna 10.

Figure 8:
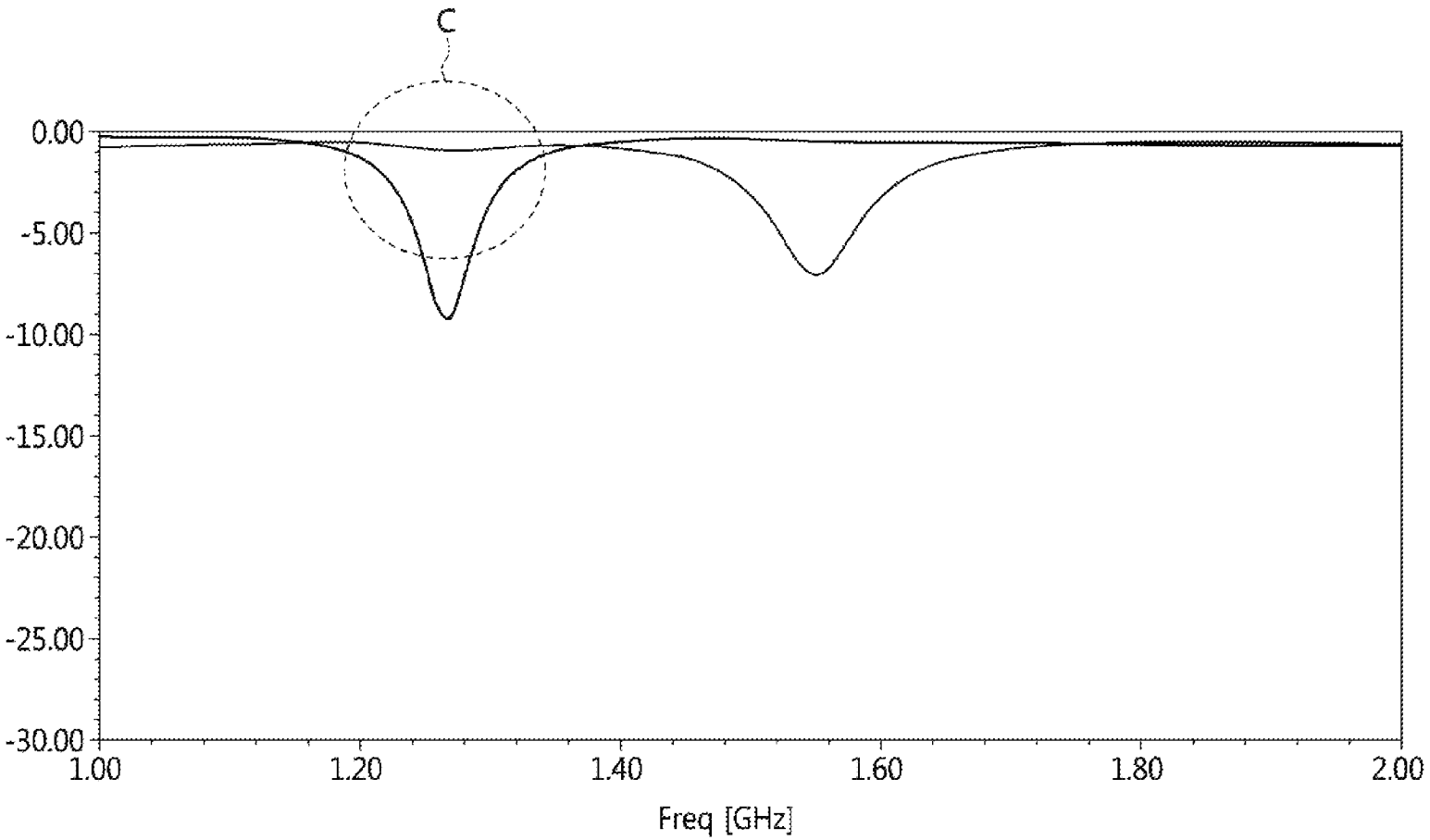
Figure 9:
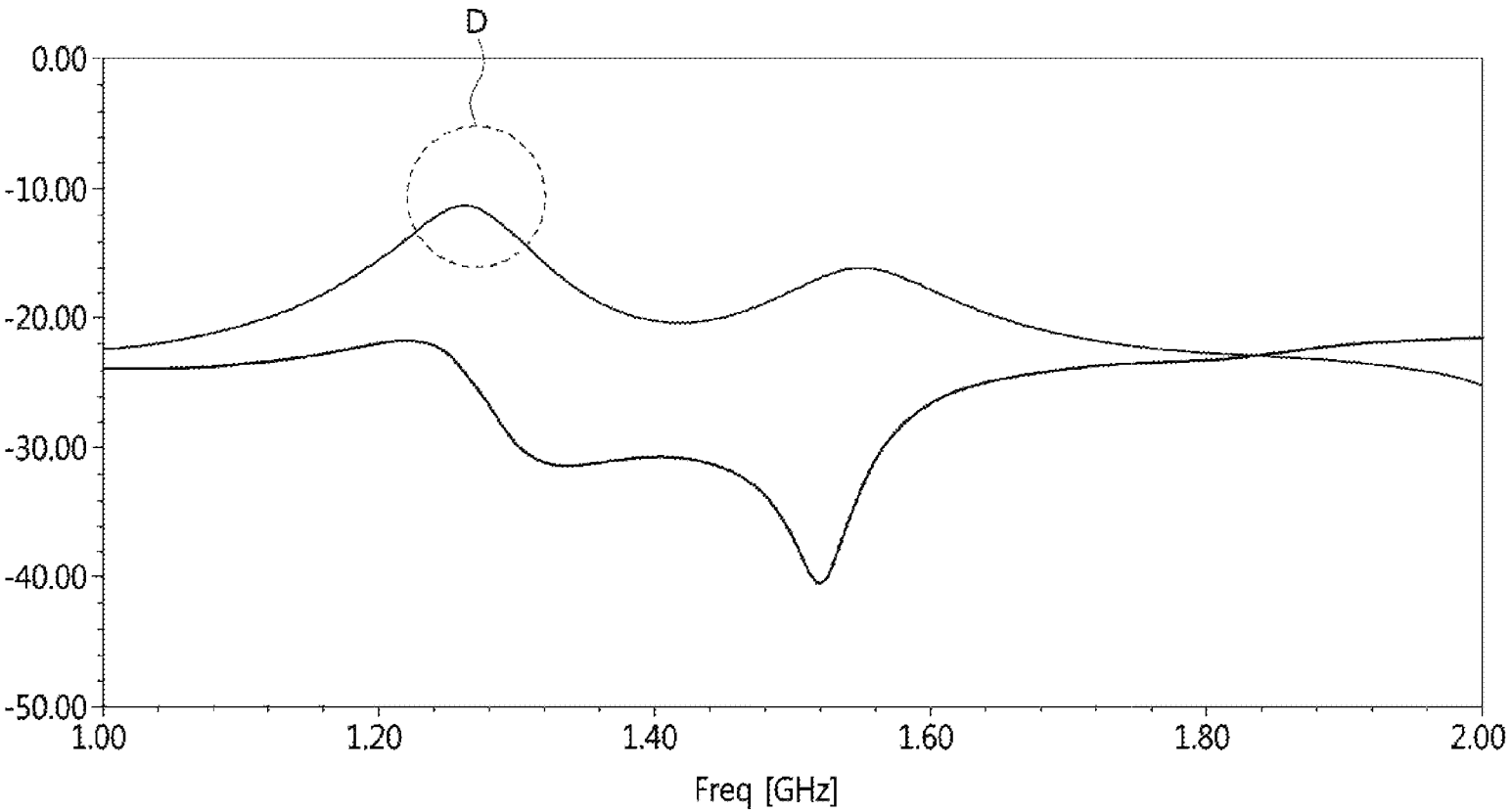

Referring to FIGS. 8 and 9, the multilayer patch antenna 100 according to an embodiment of the present disclosure may form the metal layer 160 in the thru-hole formed in the lower patch antenna 120 to constitute the coaxial cable with the power feeding pin, thereby preventing parasitic resonance from occurring (C).

Accordingly, the multilayer patch antenna 100 according to an embodiment of the present disclosure prevents the parasitic resonance from occurring, thereby forming the isolation of about 11.51 dB @1225 MHz (Peak) (D).

As a result, the multilayer patch antenna 100 according to an embodiment of the present disclosure increases the isolation by about 8.47 dB compared with the conventional multilayer patch antenna 100, and also enhances the antenna efficiency as the isolation increases.

Figure 10:
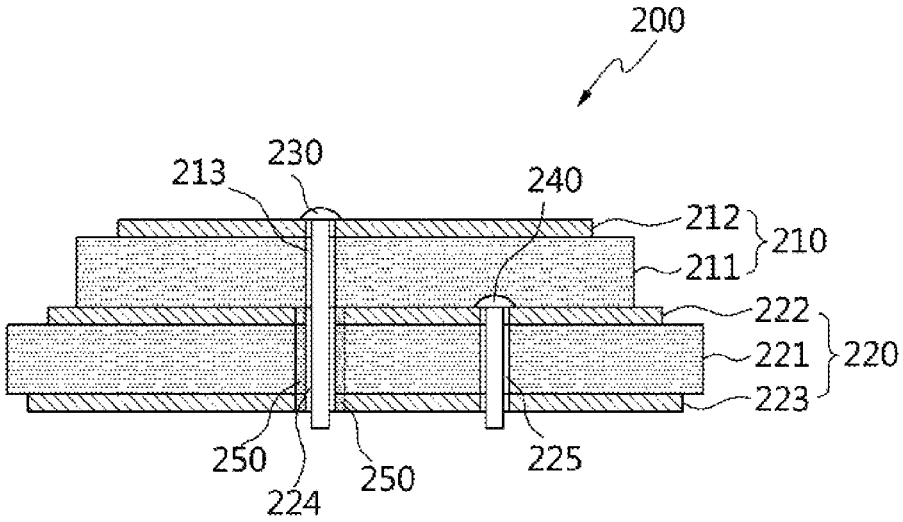
FIG. 10 is a diagram for explaining a modified example of the multilayer patch antenna according to an embodiment of the present disclosure.

Meanwhile, referring to FIG. 10, a multilayer patch antenna 200 is configured to include an upper patch antenna 210, a lower patch antenna 220, an upper power feeding pin 230, a lower power feeding pin 240 (i.e., the third power feeding pin 150), and a metal layer 250. Here, the upper power feeding pin 230 is one selected from the first power feeding pin 130 and the second power feeding pin 140 described above, and the lower power feeding pin 240 corresponds to the third power feeding pin 150 described above.

The upper patch antenna 210 is configured to include a first base substrate 211 and a first upper radiation patch 212 disposed above the first base substrate 211. At this time, the upper patch antenna 210 is formed by penetrating the first base substrate 211 and the first upper radiation patch 212, and formed with a first thru-hole 213 through which the upper power feeding pin 230 penetrates.

The lower patch antenna 220 is configured to include a second base substrate 221, a second upper radiation patch 222 disposed above the second base substrate 221, and a lower patch 223 disposed below the second base substrate 221.

The lower patch antenna 220 is formed with a second thru-hole 224 through which the upper power feeding pin 230 penetrates and a third thru-hole 225 through which the lower power feeding pin 240 penetrates. The second thru-hole 224 is formed by penetrating the second base substrate 221, the second upper radiation patch 222, and the lower patch 223. The third thru-hole 225 is formed by penetrating the second base substrate 221, the second upper radiation patch 222, and the lower patch 223, and formed to be spaced apart from the second thru-hole 224.

The metal layer 250 is formed in the second thru-hole 224 of the lower patch antenna 220. That is, the metal layer 250 is formed on the inner wall surface of the second thru-hole 224. At this time, the metal layer 250 is spaced at a predetermined interval apart from the outer circumference of the upper power feeding pin 230 penetrating the second thru-hole 224.

The metal layer 250 is made of one material selected from copper, aluminum, gold, and silver. Of course, the metal layer 250 may also be made of an alloy containing one material selected from copper, aluminum, gold, and silver.

The metal layer 250 constitutes a coaxial cable with the upper power feeding pin 230. As a result, the metal layer 250 removes parasitic resonance occurred by the coupling between the upper power feeding pin 230 and the lower patch antenna 220. Accordingly, the multilayer patch antenna 200 may prevent the isolation from being reduced by the parasitic resonance.

As described above, although the preferred embodiment according to the present disclosure has been described, it is understood that modifications may be made in various forms, and those skilled in the art may carry out various changes and modifications without departing from the scope of claims of the present disclosure.

The invention claimed is:

1. A multilayer patch antenna, comprising:

an upper patch antenna having a first thru-hole formed therein;

a lower patch antenna having a second thru-hole and a third thru-hole formed to be spaced apart from each other;

a first upper power feeding pin protruding under the lower patch antenna by penetrating the first thru-hole and the second thru-hole;

a lower power feeding pin protruding under the lower patch antenna by penetrating the third thru-hole; and a first metal layer formed on an inner wall surface of the second thru-hole, wherein the upper patch antenna is further formed with a fourth thru-hole spaced apart from the first thru-hole, wherein the lower patch antenna is further formed with a fifth thru-hole spaced apart from the second thru-hole and the third thru-hole, wherein the second thru-hole penetrates an upper radiation patch, a base substrate, and a lower radiation patch of the lower patch antenna, thereby preventing occurrence of parasitic resonance, and wherein the multilayer patch antenna further comprises a second upper power feeding pin penetrating the fourth thru-hole and the fifth thru-hole to be protruded downwards from the lower patch antenna.

2. The multilayer patch antenna of claim 1, wherein the first metal layer is connected to the upper radiation patch and the lower radiation patch.

3. The multilayer patch antenna of claim 1, wherein the first metal layer is formed on the inner wall surface of the second thru-hole formed in the base substrate, the upper radiation patch, and the lower radiation patch.

4. The multilayer patch antenna of claim 1,
wherein the first metal layer is disposed to be spaced apart from an outer circumference of the first upper power feeding pin penetrating the second thru-hole.

5. The multilayer patch antenna of claim 1,
further comprising a second metal layer formed on an inner wall surface of the fifth thru-hole.

6. The multilayer patch antenna of claim 5,
wherein the fifth thru-hole penetrates an upper radiation patch, a base substrate, and a lower radiation patch of the lower patch antenna, and
wherein the second metal layer is formed on the inner wall surface of the fifth thru-hole formed in the base substrate.

7. The multilayer patch antenna of claim 6,
wherein the second metal layer is connected to the upper radiation patch and the lower radiation patch.

8. The multilayer patch antenna of claim 5,
wherein the fifth thru-hole penetrates an upper radiation patch, a base substrate, and a lower radiation patch of the lower patch antenna, and
wherein the second metal layer is formed on the inner wall surface of the fifth thru-hole formed in the base substrate, the upper radiation patch, and the lower radiation patch.

9. The multilayer patch antenna of claim 5,
wherein the second metal layer is disposed to be spaced apart from an outer circumference of the second upper power feeding pin penetrating the fifth thru-hole.

* * * * *